United States Patent [19]

Braun

[11] Patent Number: 4,942,408

[45] Date of Patent: Jul. 17, 1990

[54] BUBBLE INK JET PRINT HEAD AND CARTRIDGE CONSTRUCTION AND FABRICATION METHOD

[75] Inventor: Hilarion Braun, Xenia, Ohio

[73] Assignee: Eastman Kodak Company, Rochester, N.Y.

[21] Appl. No.: 342,135

[22] Filed: Apr. 24, 1989

[51] Int. Cl.[5] ..... B41V 2/05; B41V 2/175

[52] U.S. Cl. ..... 346/140 R

[58] Field of Search ..... 346/140

[56] References Cited

U.S. PATENT DOCUMENTS

| | | | |
|---|---|---|---|
| 4,490,728 | 12/1984 | Vaught | 346/140 X |
| 4,500,895 | 2/1985 | Buck | 346/140 |
| 4,502,060 | 2/1985 | Rankin et al. | 346/140 |
| 4,558,333 | 12/1985 | Sugitani et al. | 346/140 |
| 4,568,953 | 2/1986 | Aoki et al. | 346/140 |
| 4,611,219 | 9/1986 | Sugitani et al. | 346/140 |
| 4,695,854 | 9/1987 | Cruz-Uribe | 346/140 |
| 4,712,172 | 12/1987 | Kiyohara | 346/140 X |
| 4,734,717 | 3/1988 | Rayfield | 346/140 |
| 4,746,935 | 5/1988 | Allen | 346/140 |

FOREIGN PATENT DOCUMENTS 256659 11/1987 Japan .

*Primary Examiner*—Joseph W. Hartary
*Attorney, Agent, or Firm*—John D. Husser

[57] ABSTRACT

A bubble jet print cartridge assembly includes an ink supply housing having an ink reservoir and a fluid block component capping the ink reservoir and having ink passages extending from the reservoir to an ink outlet(s). A drop ejection chip comprising a substrate having resistive heater elements and electrode leads is attached to the outer side of the fluid block component with a peripheral chip edge(s) adjacent the ink outlet(s). A raised ink barrier fence formed on the outer surfaces of the fluid block and chip surrounds the heater elements and ink outlet(s). The fence has a height extending above the top surface of the supported chip and an orifice plate member is affixed at its periphery to the top of the barrier fence so as to enclose the region surrounded by said barrier fence.

8 Claims, 6 Drawing Sheets

BUBBLE INK JET PRINT HEAD AND CARTRIDGE CONSTRUCTION AND FABRICATION METHOD

FIELD OF THE INVENTION

The present invention relates to print heads and cartridges for thermal, drop-on-demand, ink jet (i.e. herein termed "bubble jet") printing and more particularly to constructions that improve such print/cartridges by providing novel ink paths between the ink supply reservoir and the drop formation zone.

BACKGROUND ART

As the development of bubble jet devices has progressed, two general categories of drop ejection approach have evolved: (i) ejecting drops in a direction generally parllel to the surfaces of the heater elements and their electrical circuitry and (ii) ejecting drops in a direction generally normal to the heater element surfaces. U.S. Pat. No. 4,330,787 describes several advantages of the latter category of devices, herein termed "normal drop ejector" devices.

Another way in which such bubble jet devices can be catorgorized is as to whether the print head has a remote ink supply reservoir, coupled to the print head by an umbilical, or has an attached ink supply. In the latter category of devices the print head and ink supply form a print/cartridge which can be transversed within the printer as a unit and the print/cartridge or its ink container component is replaced when the ink is exhausted. The remote and attached ink supply approaches each has its own advantages, for different printer embodiments. For example, the removable print/cartridge approach is desireable for small, portable printers and a large number of different configurations have been devised for print/cartridge devices.

As can be noted for example in U.S. Pat. Nos. 4,567,493; 4,500,895; 4,680,859 and 4,771,295, the typical approach for providing ink passage from the ink reservoir of a print/cartridge to the drop ejection zone, is by forming an openings, e.g. holes or slots, through the driver chip on which the heater elements and leads are formed. This approach works particularly well for "normal drop ejector" devices because the ink reservoir can then be located on the opposite side of the driver chip from the orifice plate and printing zone.

However, the forming of openings through the driver chip presents some difficulties. First, this necessitates an additional fabrication step which is time consuming and can itself damage the fragile chip substrates. Second, the existence of slots or holes through the chip weaken its structural integrity and can result in breaking or cracking during subsequent assembly steps of the print/cartridge fabrication. Also, such openings occupy a portion of the chip operative surface area.

SUMMARY OF THE INVENTION

One important purpose of the present invention is to provide improved configurations for print/cartridges, of the "normal drop ejection" kind, to obviate the need for forming holes or slots through the print/cartridge driver chip. Another, related, purpose of the present invention is to provide a print/cartridge construction which has an overall configuration that is simple to fabricate and which operates with good reliability in supplying ink from the supply to the print medium. Another object of the present invention is to provide improved methods for fabricating such print/cartridges.

In one preferred embodiment, the present invention constitutes an improved bubble jet print cartridge of the kind having an ink reservoir that is capped by a print head support and ink distribution component. This cap component has an ink passage(s) extending therethrough from the ink reservoir to an ink outlet(s) on its outer side. A driver chip, comprising a dielectric substrate with resistive heater elements and heater leads supported on its top surface is attached with the chip bottom surface opposing the outer side of the cap component and with peripheral edge(s) adjacent the ink outlet(s) of the cap component. An ink barrier fence is formed on the outer side of the cap component, surrounding the driver chip and the ink outlet(s). An orifice plate member is affixed around its periphery to the top of the ink barrier fence.

BRIEF DESCRIPTION OF THE DRAWINGS

The subsequent description of preferred embodiments refers to the accompanying drawings wherein.

DETAILED DESCRIPTION OF THE PREFERRED EMBODIMENTS

Figure 1:
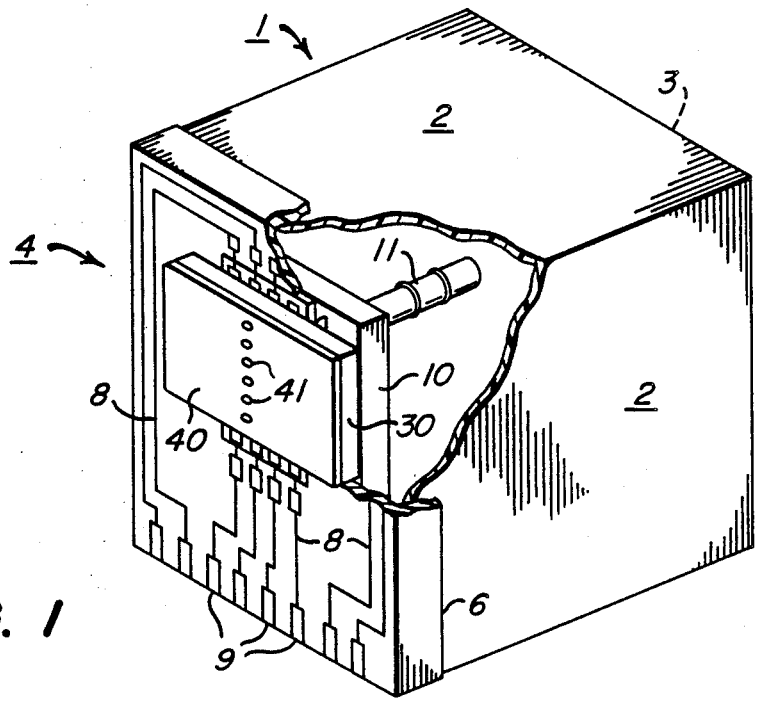
FIG. 1 is a perspective view of one preferred print/cartridge in accord with the present invention.
Figure 2A:
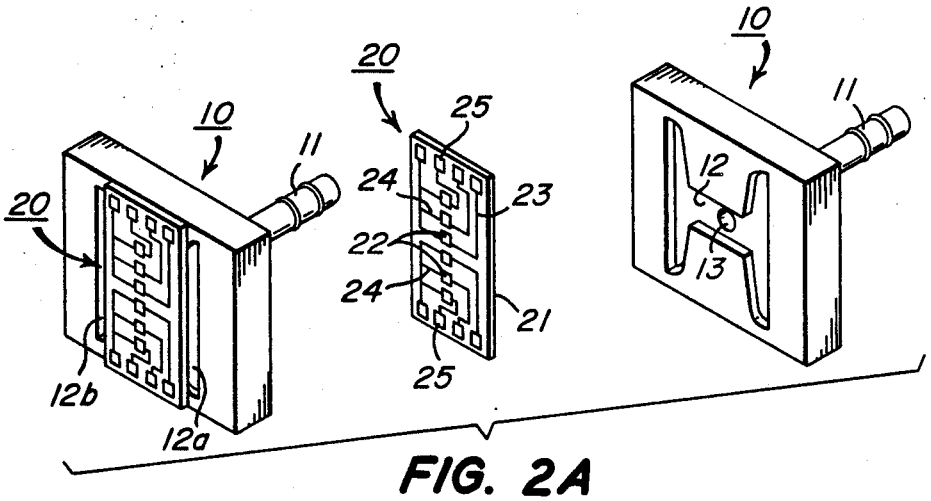
FIGS. 2-A through 2-D are perspective views showing the detail constructions of the components of the FIG. 1 print cartridge and schematically illustrating the steps of fabricating such a print/cartridge.
Figure 2B:
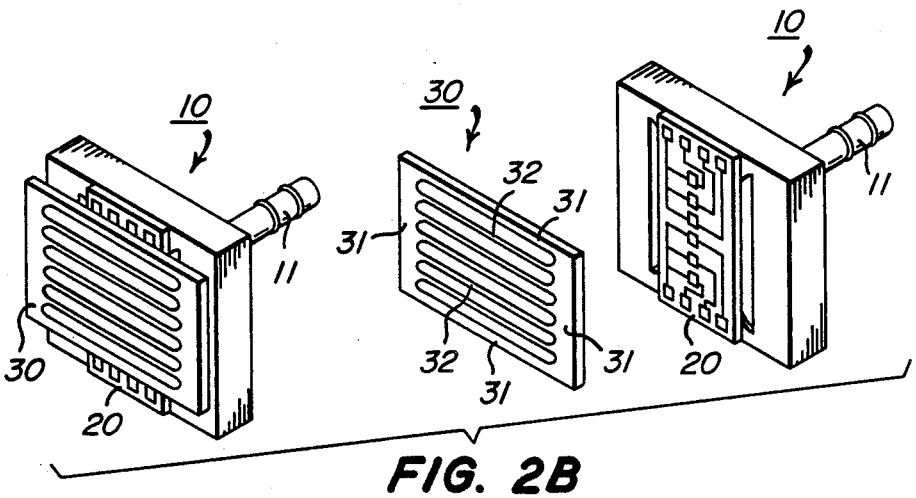
Figure 2C:
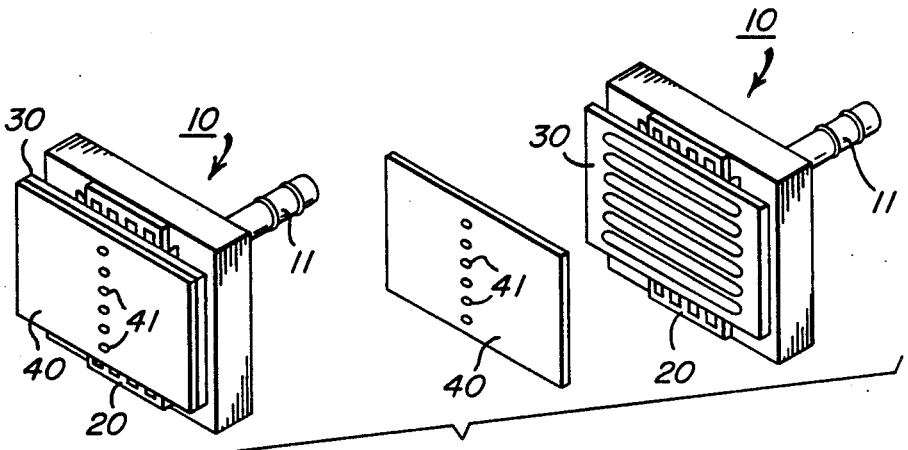
Figure 2D:
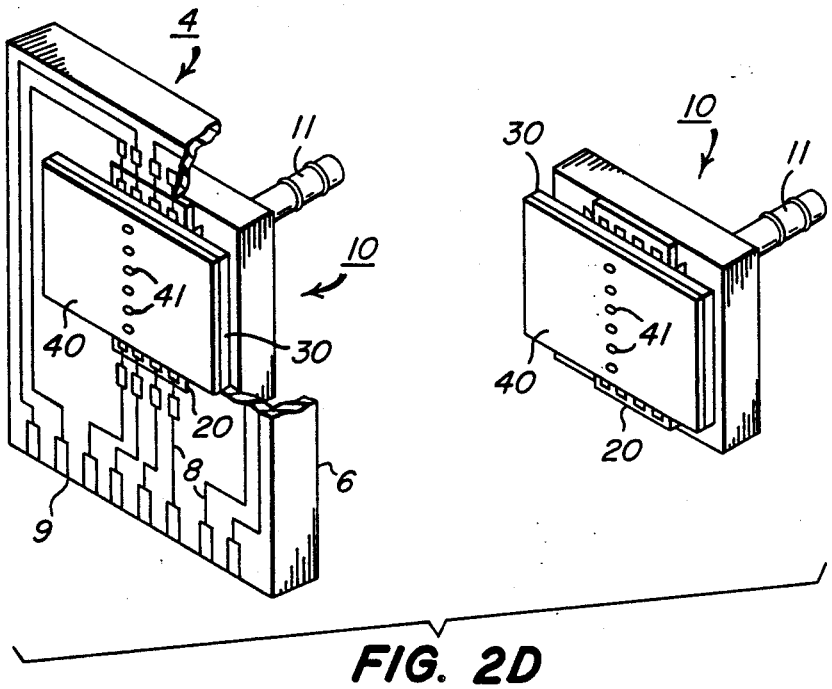
Figure 3A:
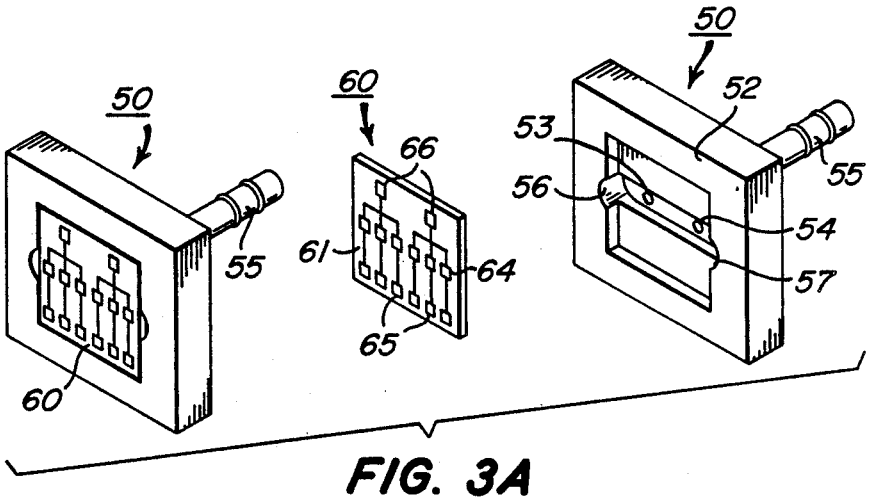
FIGS. 3-A through 3-E are perspective views similar to FIGS. 2 but showing another preferred print/cartridge and fabrication method in accord with the present invention.
Figure 3B:
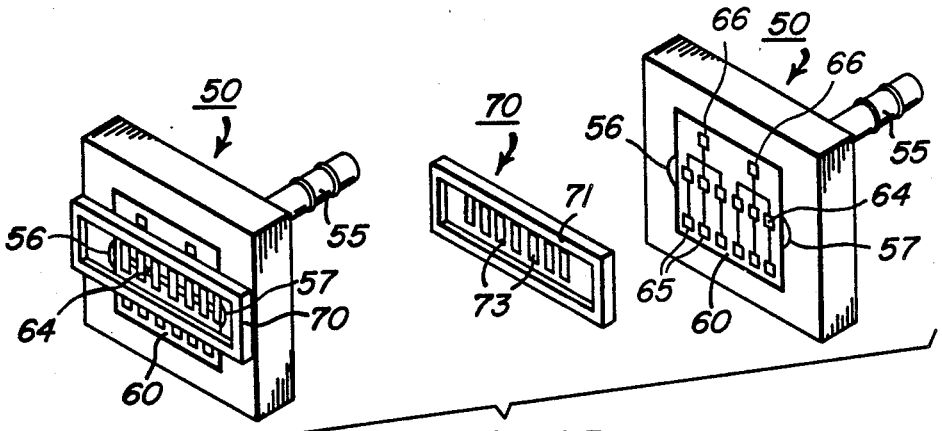
Figure 3C:
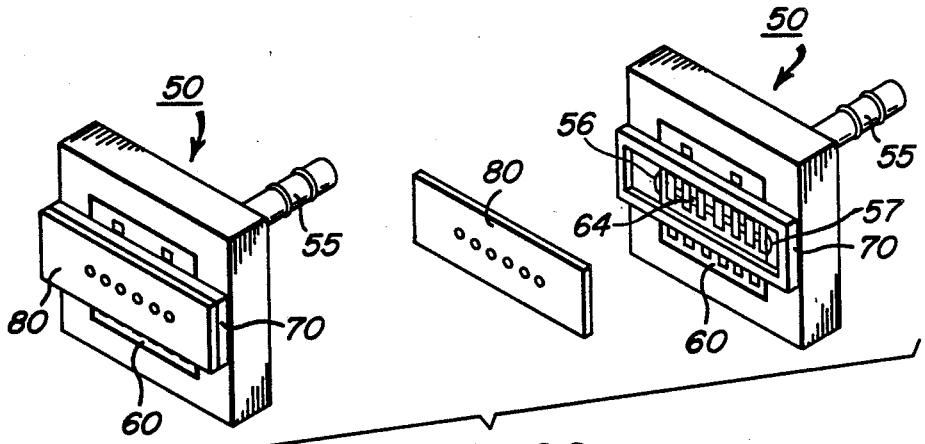
Figure 3D:
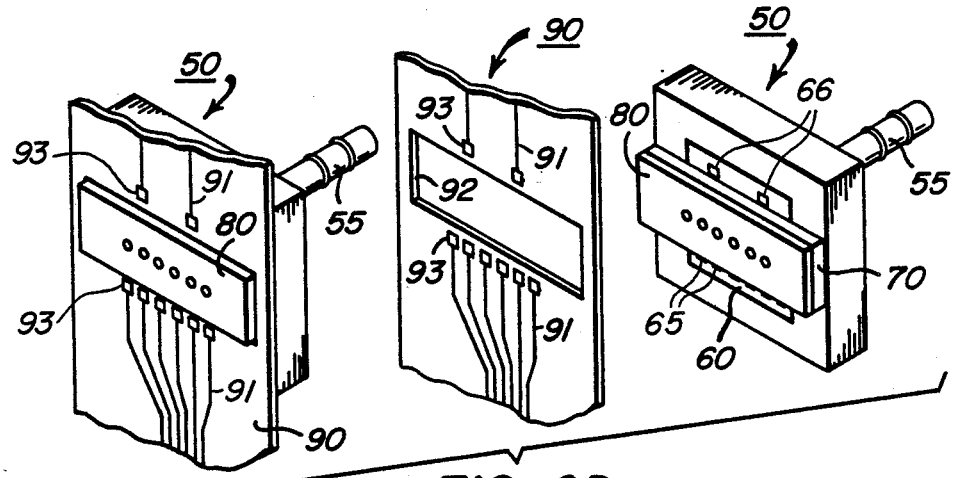
Figure 3E:
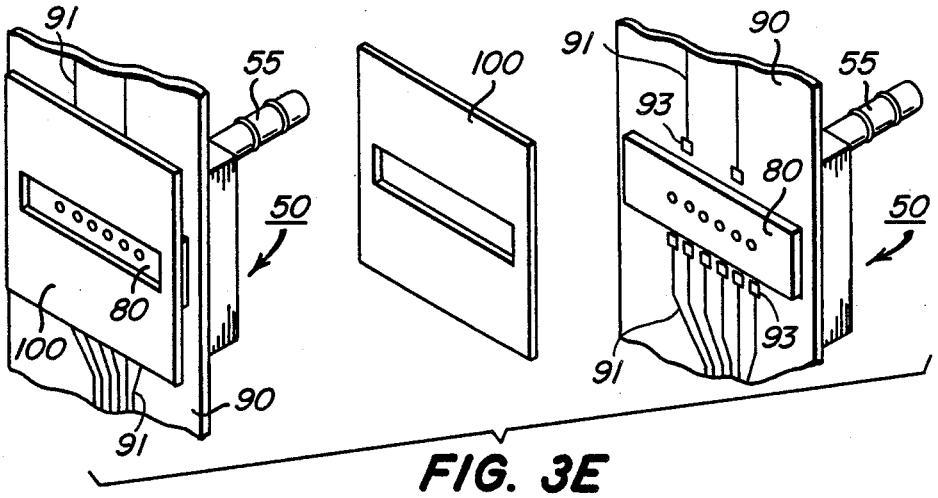
Figure 4A:
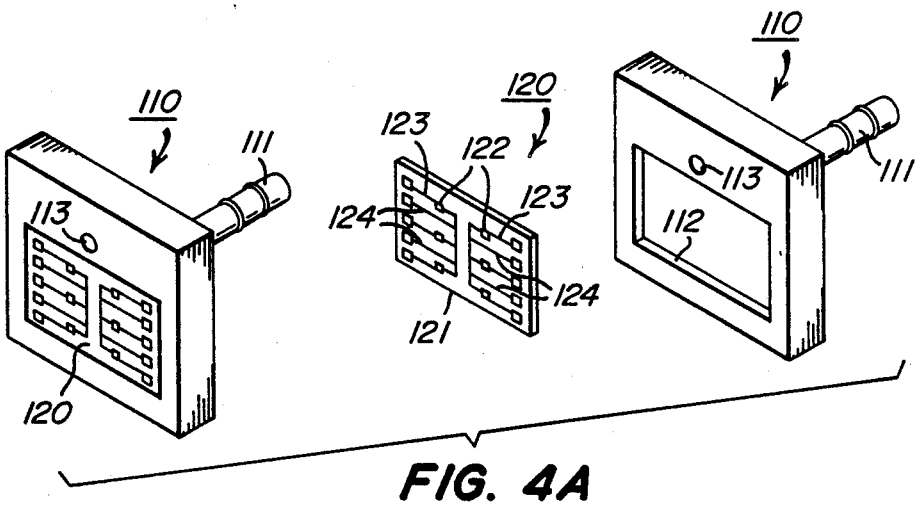
FIGS. 4-A through 4-D are perspective views similar to FIGS. 2 and 3 but showing yet another preferred embodiment of the present invention.
Figure 4B:
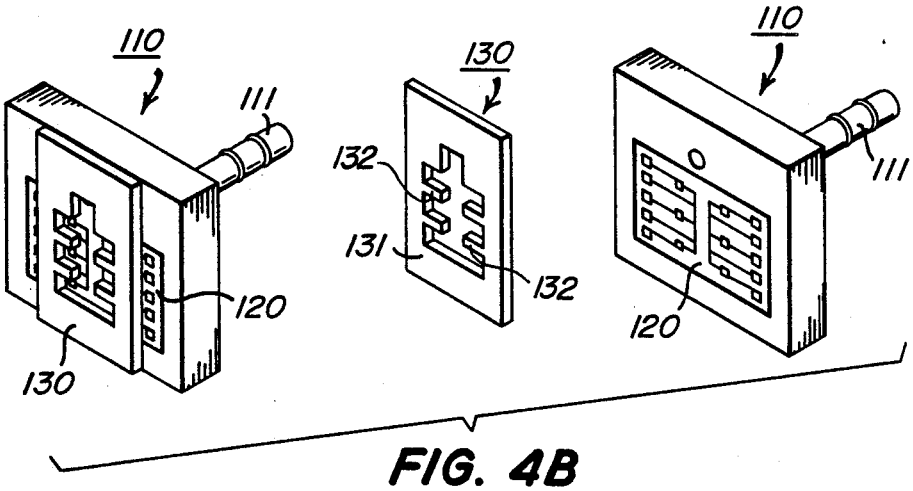
Figure 4C:
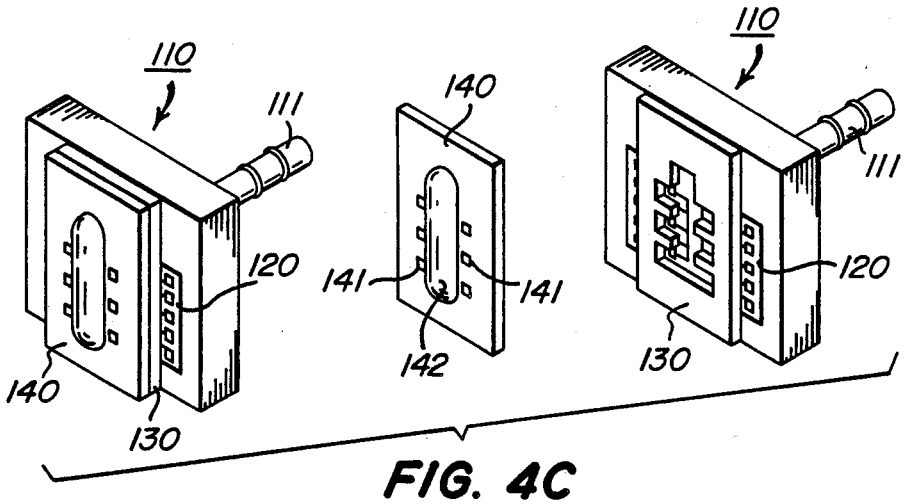
Figure 4D:
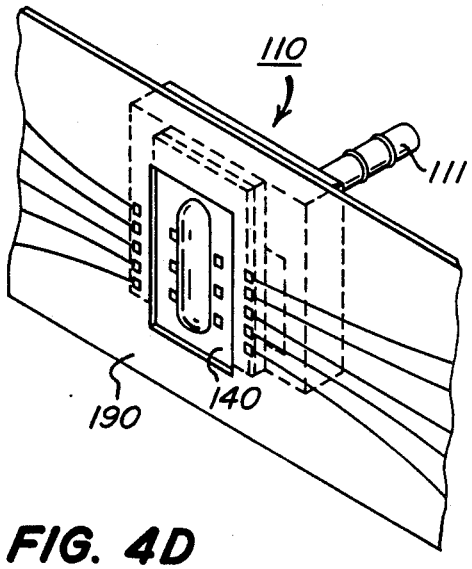

The print/cartridge 1 shown in FIG. 1, constructed in accord with one preferred embodiment of the present invention, includes an ink reservoir housing comprised of side walls 2, bottom walls 3 and cap assembly 4. The cap assembly can comprise a closure and frame component 6 that is sized to interfit around the top ends of walls 2 of the reservoir and a fluid block component 10 that is constructed to interfit with the inner periphery of frame component 6.

As shown in FIG. 2-A the fluid block component 10 has an inlet tube 11 extending from its rear (inner) surface into the ink supply reservoir and an "H" shaped recess 12 formed in its forward (outer) surface. A passage 13 extends from the tube 11 through the thickness of the fluid block component and opens at the center of recess 12. The coupling branch passages of recess 12 provide for ink flow to the opposing parallel portions of that recess. If desired, the fluid block and frame component can be formed as an integral capping part.

As best shown in FIG. 2-A, a drop ejection chip 20 is mounted atop fluid block 10. Chip 20 can comprise a dielectric, e.g. silicon or glass, substrate 21 having formed thereon a plurality of resistive heater elements 22, selecting electrodes 23, reference electrodes 24 and connection terminals 25. The heater elements and electrodes can be overcoated with appropriate insulative and protective layers (not shown but known in the art). The recess 12 is sized relative to the chip substrate 21 so that, when chip 20 is mounted on the fluid block component 10 and over the branch passages of the recess 12, the recess 12 is mainly covered by the lower surface of substrate 21. However, at least a part of the parallel recess portions 12*a*, 12*b*, remain open to allow ink flow from the reservoir to the edges of the chip 20.

Next, as shown in FIG. 2-B, an ink barrier and manifold layer 30, e.g. a polymer, is formed or attached on the top of the chip and fluid block composite. The layer 30 forms an ink barrier fence 31 that surrounds the open recess portions 12*a*, 12*b* and the resistive heater elements 22 of the chip. The polymer layer 30 can also comprise a series of baffle walls 32 that extend over the surface of chip 20, between recesses 12*a*, 12*b*, and separate the individual resistive heater elements 22. This provides each heater element a relatively isolated flow of ink from its respective channel, formed between baffle walls 32.

Next, as shown best in FIG. 2-C, an orifice plate 40 is attached to the barrier and manifold layer 30. The orifice plate 40 can be formed, e.g., by electroplating onto a mandrel having photoresist pegs that form the orifice openings 41. The orifices 41 are formed in a pattern conforming to the pattern of heater elements 22 on chip 20, and the orifice plate is attached, e.g. with adhesive, to top of the ink barrier fence portions 31 of layer 30 so as to cover recesses 12*a*, 12*b* and the channels formed by the baffle walls 32 of that layer. The orifices 41 are respectively aligned between baffle walls 32 and directly over respective heater elements 22 so that ink bubble formation, caused by heating of a resistive element, will effect drop ejection of ink in through its related orifice.

Next, as shown in FIG. 2-D, the fluid block component 10 is mounted into frame 6, and electrical leads 8 and connector pads 9 are formed repectively for each of the terminal portions 25 on chip 20. Thus, when a print-/cartridge is inserted into a printer, the connector pads 9 can be coupled to printer drive circuits to provide for selective firing of the heater elements 22.

Finally, the print/cartridge fabrication is completed by securing the top cap assembly 4, with all its supported components just described, to a reservoir housing full of ink. The print/cartridge can then be mounted into a printer and ink, which flows from the ink reservoir through tube 11 and opening 13 to recess portions 12*a*, 12*b*, thence over the top of the chip edges to and between baffle walls 32, can be ejected by heater activations. In this regard, all the foregoing passage structure preferably can be made of a size and material that effects capillary transport of the ink liquid. Alternatively, the ink reservoir housing can be formed as a separate unit, e.g. with a frangible cover and means for removable attachment to the top cap assembly.

Considerably the foregoing, it will be seen that in the print/cartridge 1, effective supply of ink is provided from a rear end reservoir to a normal drop ejector print head in a compact construction, which does not require an opening in the fragile drop ejection chip.

FIGS. 3-A through 3-E illustrate another preferred print/cartridge construction in accord with the present invention. In this embodiment, the fluid block 50 comprises a recess configured to receive drop ejection chip 60 with its top surface 61 approximately flush with the top surface 52 of the fluid block. The fluid block 50 also has formed therein ink supply passages 53, 54 which lead from inlet tube 55, beneath the exposed surface of recess 51 to ink supply outlet passages 56, 57 that egress adjacent opposing peripheral edges of recess 51. Driver chip 60 has resistive heater elements 64 and electrodes 65, 66 formed generally as described above, but in a different pattern.

After drop ejection chip 60 is affixed within recess 51 as shown in FIG. 3-B, an ink barrier and manifold structure 70 is formed over the top surfaces of the chip and fluid block. The barrier portion 71 of the structure surrounds the outlet openings 56, 57 and resistive heater elements 64, and the manifold portions 73 provide channels between the heater elements. As shown in FIG. 3-B the structure 70 also forms side channels along each inner edge of the barrier portion 71 so that ink can flow to all heater elements. Again, the portions of structure 70 are raised from top surfaces 52, 61 so that orifice plate 80 can be attached to the top of structure 70 and provide a capillay spacing between the inner surface of the orifice plate and the top surfaces of the drop ejection chip 60.

After the orifice plate 80 is affixed to cover the region surrounded by barrier portion 71, a film 90 bearing lead connector 91 is mounted with its opening 92 over the orifice plate 80 and its lead ends 93 coupled to the driver chip terminals 65, 66, as shown in FIG. 3-D. Next, a coating 100, e.g. of polyamide, is provided over the upper surfaces of fluid block assembly and its supported elements, except the orifice region of the orifice plate 80, see FIG. 3-E. The assembly is now ready for mounting in a frame member (such as frame 6 shown in FIG. 1) and attachment to a filled ink reservoir to complete the print/cartridge fabrication.

FIGS. 4-A through 4-D show still another preferred embodiment of the present invention. Referring to FIG. 4-A, it can be seen that the fluid block component 110 has a central opening 112, an inlet tube 111 extending from its rear surface through an outlet passage 113 to an egress adjacent the periphery of opening 112. The opening 112 has a periphery configuration shaped to receive the edges of chip 120 and can have a thickness greater than the chip thickness so as to also support a heat sink element (not shown, but located in heat transfer relation with the bottom of chip 120) to control the chip substrate temperature, if desired.

Chip 120 comprises a substrate 121, resisitve heater elements 122 and address and reference electrode leads 123, 124 generally same as described with respect to FIGS. 2, but having a different layout. The chip 120 is mounted within the central opening of fluid block component 110 so that its operative ejection surface structure is generally flush with the top surface of the fluid block component.

Next, as shown in FIG. 4-B an ink barrier and manifold layer 130 is formed over the top surfaces of components 110, 120 to provide a raised fence portion 131 that surrounds that ink egress 113 and the resistive heater elements 122. In this embodiment, layer 130 comprises manifold finger portions 132 which extend from the interior of the fence portion 131, between the heater elements 122. Thus ink can flow from egress passage 113, along a central channel between the heater elements and into branches between the finger portions 132.

Next, an orifice plate 140 having a pair of linear orifice arrays 141 is affixed over the top of layer 130 with the orifices over respective heater elements 122. The orifice plate 140 also is electroformed to have an elongated dome portion 142 that extends between the orifice arrays 141. When the orifice plate is mounted the dome position 142 has one end location over egress passage 113 and extends over the central channel of layer 130 to increase the ink volume in this central region between heater elements. This is useful to provide fluidic damping at higher drop ejection rates.

Finally, as shown in FIG. 4-D a film 190 bearing connector lines 191, 192 is attached to the electrodes 123, 124 of chip 120. Then, a protective coating is applied over the assembled unit, except the central orifice plate region, as described with respect to FIGS. 3; and the unit is ready for mounting in a print/cartridge device.

The invention has been described in detail with particular reference to certain preferred embodiments thereof, but it will be understood that variations and modifications can be effected within the spirit and scope of the invention.

I claim:

1. A bubble jet print cartridge of the normal drop ejection kind comprising:

(a) an ink housing including an enclosed ink reservoir region and an ink supply and distribution wall member having (i) top and bottom surfaces and (ii) ink passage means extendng from a central region of said bottom wall surface, covering said reservoir region, to an outlet(s) on the outer periphery of said top surface of said wall member;

(b) a drop ejection chip comprising a continuous substrate having resistive heater elements and electrode leads supported on an upper surface thereof, the lower surface of said substrate being attached to said wall member top surface with a peripheral chip edge(s) adjacent, but not covering, said ink outlets(s);

(c) a raised ink barrier fence formed on the upper surface of said wall member and said upper chip surface to surround said heater elements of said chip and said ink outlet(s), said fence having a height extending above the top surface of said supported chip; and (d) an orifice plate member affixed at its periphery to the top of said barrier fence.

2. The invention as defined in claim 1 wherein said barrier fence comprises a polymer wall element and further including a plurality of polymer baffle wall elements formed within said fence between resistive heater elements on said chip.

3. A disposable, bubble jet print/cartridge of the normal drop ejection kind comprising:

(a) means defining an ink reservoir having an outlet opening;

(b) a reservoir cap member attached to said reservoir means to cover said outlet opening, said cap member having top and bottom surfaces and a bifurcated ink passage formed between said surfaces such that an inlet portion of said passage opens to said reservoir means from the central region of said bottom surface and divides within the body of said cap member into a plurality of outlet passages that form egress openings at peripheral edge regions of said member top surface;

(c) a drop ejector chip comprising resistive heater elements and electrode leads formed on a top surface of a continuous substrate, said chip being mounted on the top surface of said cap member with the bottom surface of said continuous substrate completely overlying the center portion of said cap member and said substrate edges located between said cap egress openings;

(d) a peripheral barrier portion formed around the edges of said cap top surface so as to surround said egress openings and said heater elements, but exclude terminal portions of said electrode leads; and (e) an orifice plate mounted on said barrier portion and covering the region within said barrier portion.

4. The invention defined in claim 3 wherein said ejector chip comprises at least two adjacent rows of heater elements with continuous substrate therebetween.

5. A normal drop ejection, bubble jet printer head and cartridge assembly comprising:

(a) an ink storage and supply housing forming an ink reservoir region;

(b) a fluid block component coupled to enclose said supply housing and having ink passage means extending therethrough from a central region of its bottom surface covering said reservoir region to ink outlets at the edges of its top surface;

(c) a drop ejection chip comprising a substrate having resistive heater elements and electrodes leads supported on an upper surface thereof, said substrate being attached to the top surface of said fluid block component with peripheral chip edges adjacent but not covering said ink outlets;

(d) a raised ink barrier fence formed on the outer surfaces of said block and chip so as to surround said heater elements and said ink outlets, said fence having a height extending above the top surface of said supported chip; and (e) an orifice plate member affixed at its periphery to the top of said barrier fence so as to enclose the region surrounded by said barrier fence.

6. The invention as defined in claim 5 wherein said barrier fence comprises a polymer wall element and further includes a plurality of polymer baffle wall elements formed within said fence between resistive heater elements on said chip.

7. The invention defined in claim 6 wherein said barrier fence excludes terminal portions of said electrode leads from said ink outlet(s).

8. The invention defined in claim 5 wherein said ejector chip comprises at least two adjacent rows of heater elements with continuous substrate therebetween.

* * * * *